US006760462B1

(12) United States Patent
Thigpen

(10) Patent No.: US 6,760,462 B1
(45) Date of Patent: Jul. 6, 2004

(54) PLANAR DIAPHRAGM LOUDSPEAKERS WITH NON-UNIFORM AIR RESISTIVE LOADING FOR LOW FREQUENCY MODAL CONTROL

(75) Inventor: F. Bruce Thigpen, Tallahassee, FL (US)

(73) Assignee: Eminent Technology Incorporated, Tallahassee, FL (US)

( * ) Notice: Subject to any disclaimer, the term of this patent is extended or adjusted under 35 U.S.C. 154(b) by 0 days.

(21) Appl. No.: 10/338,690

(22) Filed: Jan. 9, 2003

(51) Int. Cl.[7] ..... H04R 25/00
(52) U.S. Cl. ..... 381/431; 381/408
(58) Field of Search ..... 381/113, 116, 381/191, 408, 431, 96, 174, 399, 412, 353

(56) References Cited

U.S. PATENT DOCUMENTS

| | | | | |
|---|---|---|---|---|
| 2,445,821 A | | 7/1948 | Brewer | |
| 3,008,013 A | | 11/1961 | Williamson et al. | |
| 3,008,014 A | | 11/1961 | Williamson et al. | |
| 3,190,972 A | | 6/1965 | Schoeps et al. | |
| 3,894,333 A | | 7/1975 | Chang | |
| 3,898,598 A | * | 8/1975 | Asahi | 381/431 |
| 4,020,299 A | | 4/1977 | Garner et al. | |
| 4,703,509 A | | 10/1987 | Kanchev | |
| 4,837,838 A | | 6/1989 | Thigpen et al. | |
| 5,146,435 A | | 9/1992 | Bernstein | |
| 5,425,107 A | | 6/1995 | Bertagni et al. | |
| 5,539,835 A | | 7/1996 | Bertagni et al. | |
| 5,668,886 A | | 9/1997 | Sakamoto et al. | |
| 6,097,830 A | | 8/2000 | Zelinka et al. | |
| 6,104,825 A | | 8/2000 | Thigpen | |
| 6,185,310 B1 | | 2/2001 | Kermani et al. | |

* cited by examiner

*Primary Examiner*—Huyen Le
(74) *Attorney, Agent, or Firm*—Dowell & Dowell, P.C.

(57) ABSTRACT

A loudspeaker, and particularly, a woofer, including a flat diaphragm transducer having at least one stator plate for carrying magnetic elements in close proximity to a low stiffness diaphragm wherein a piston-like motion of the diaphragm is achieved by creating pressure zones adjacent the diaphragm to improve an acoustic coupling and increase acoustic output for a given size of diaphragm by the provision of non-uniformly spaced openings in the at least one stator plate which are selectively spaced to control low frequency diaphragm resonance modes.

14 Claims, 6 Drawing Sheets

PLANAR DIAPHRAGM LOUDSPEAKERS WITH NON-UNIFORM AIR RESISTIVE LOADING FOR LOW FREQUENCY MODAL CONTROL

BACKGROUND OF THE INVENTION

1. Field of the Invention

The present invention is directed to acoustic loudspeakers including transducers having at least one stator plate closely adjacent to which is mounted a flexible diaphragm carrying an electrical circuit wherein magnetic elements carried by the stator plate cooperate with the electrical circuit of the diaphragm to drive the diaphragm when energy is applied to the electrical circuit. More particularly, the invention is directed to controlling the modal behavior of the flexible diaphragm by creating selective air resistance adjacent to the diaphragm in order to enable the diaphragm to function in a piston-like manner over a wide frequency range to thereby improve acoustic coupling and increase the acoustic output for the transducer of the loudspeaker.

2. Description of the Related Art

The mechanical properties of thin film or non-rigid diaphragm loudspeakers are such that, at high frequencies, air mass controls the high frequency operation and the mechanical stiffness of the diaphragms controls the lowest frequency performance of the loudspeakers.

Traditional low frequency planar transducer systems with stretched diaphragms utilize cloth, baffles or other forms of resistive loading to damp peaks in a system's response. These resistive methods serve to decrease the output at resonance but do not maintain the output where the diaphragm exhibits out-of-phase modal problems at certain frequencies. The result is a system that exhibits poor frequency and phase response with lower overall acoustic output, for a given input power.

The support structure for a stator or grid of a planar magnetic or electrostatic loudspeaker, or other type of flat panel loudspeaker, incorporates perforations, holes, slots or no interface at all to allow the displacement of a thin diaphragm to couple acoustically to the surrounding medium, usually air. The diaphragm is frequently clamped at its edges and under tension.

It is generally assumed that the diaphragm behaves as a piston in operation, but a stretched membrane or non-rigid diaphragm will go through resonant modal patterns which create peaks and dips in a loudspeaker's frequency response, even if the diaphragm is driven uniformly over its entire surface area. The peaks generally coincide with in-phase motion of the diaphragm and the dips result from portions of the diaphragm operating out-of-phase with other areas of the diaphragm. This results in a poor mechanical impedance match between the diaphragm and the surrounding air. Low frequency diaphragm modes occur independent of input power and result in low acoustic output at high input power when portions of the diaphragm are moving out-of-phase with other areas of the diaphragm.

Past methods for improving a system's response have been equalization or diaphragms formed in cells where each cell has different resonance modes. U.S. Pat. No. 5,054,081 to West describes a form of diaphragm with segmented cells, each cell having a different first harmonic resonance frequency by virtue of area and tension. The sum of the resonance frequencies results in essentially flat frequency response. This method is suitable for very large diaphragms where there is sufficient area to break up the diaphragm into many small cells and recover otherwise unusable energy, but this method is not applicable for small transducers where the total area of the transducer occupies one cell. For small transducers there is insufficient area remaining to divide up and any division would result in cell resonance frequencies that are too high for wide range low frequency operation.

A significant problem for small planar magnetic and electrostatic transducers or loudspeakers is the ability to generate high acoustic output at low frequencies when compared to conventional moving coil transducers of similar size. Part of the problem is due to limited peak to peak displacement of the diaphragm in flat panel technologies. For planar magnetic loudspeakers, this is partially overcome with the use of modern magnetic materials to drive the diaphragm a primary limitation that remains is the high Q resonance which occurs at the fundamental resonance of the diaphragm. The high Q resonance occurs because of the elastic nature of the diaphragm material, the low stiffness of the diaphragm at one frequency, and the rigid support frame if used to support the diaphragm.

As magnetic circuits, magnetic materials and diaphragm materials improve, the peak to peak displacement capabilities of small planar woofers increases. This magnifies any low frequency resonance problems.

The compliance or elasticity of the materials which are desirable for use as diaphragms in planar magnetic or electrostatic transducers or loudspeakers are thin films such as Kapton™ or Mylar™ or various forms of vinyl chlorides such as Saran™. All of these films exhibit a characteristic resonance frequency when they are under tension in a rigid frame as utilized in these types of loudspeakers. These characteristics result in a "drum like" resonance which typically defines the lower limit of the frequency range of the transducers. Below this resonance frequency the stiffness of the diaphragm material is high and this limits output significantly. Use of a more compliant material or low tension causes loss of diaphragm control and high distortion from unstable motion of the diaphragms.

These drum like resonance's cause limitations in the maximum obtainable output of a planar speaker at low frequencies because the rise in amplitude at these frequencies is typically 10–15dB or more. When a music signal is passed through a speaker, if a wide range signal in the music falls on the resonant frequency, the output rises substantially, beyond what is desirable and causes diaphragm bottoming against a stator component before the maximum usable sound output of the speaker has been reached at other frequencies. If this rise in resonance is reduced then the overall low frequency output of the speaker with music signals will increase.

At resonance, a speaker's transfer efficiency is high, because of the very low stiffness of the diaphragm, but it is only at one frequency which is not useful in a loudspeaker intended for music reproduction.

Above the fundamental resonance, the diaphragm exhibits modal behavior where areas of the diaphragm move in different directions at the same time, even when driven uniformly over the entire surface of the diaphragm. The sum of the motions in different directions reduce the output. In some cases the reduction can be as much as 20 dB in acoustic output. The modal behavior and resonance modes are a significant problem with regards to achieving smooth low frequency response, high efficiency, and high acoustic output out of a small planar diaphragm.

FIG. 1 is a graphic which shows how a diaphragm clamped on two ends will respond to vibration inputs. Even with a sinusoidal input multiple harmonics are likely to exist on the diaphragm because of tension, peripheral termination and the velocity of sound along the diaphragm.

The desired motion is that of the first harmonic but the superposition of higher vibration modes such as the second harmonic when added to the fundamental result in diaphragm with less effective area and lower acoustic output.

High electrical impedance diaphragms in planar magnetic transducers or loudspeakers offer better control of modal behavior through increased back EMF, but are less efficient than low impedance diaphragms and the efficiency limitation prevents their use. Low impedance diaphragms are more desirable because of increased efficiency, however, they exhibit increased modal behavior problems. The present invention permits the use of low impedance diaphragms with greater control over the low frequency modal patterns.

U.S. Pat. No. 4,156,801 to Whelan describes a centrally driven diaphragm with baffles covering 80–85% of the non-driven area for the purpose of damping out-of-phase midrange resonance modes which cause frequency response irregularities. The design is optimized for operation from 255 hertz up and operation below this frequency is not discussed. Additional conductor area under the baffles has a less beneficial effect on the output of the speaker due to the very high stiffness of the air under the baffles.

U.S. Pat. No. 3,832,499 to Heil describes a magnetic circuit with a pole piece arrangement where the velocity of air between the pole pieces is accelerated but the effect is said to be beneficial only at very high frequencies.

As previously noted, current state of the art planar transducers utilize a uniform air load by means of perforations around the diaphragm or cloth to damp the resonance modes that result from tension. Resistive loading is accomplished by limiting the "open area" exposed to the surrounding air by means of baffles or the application of cloth, foam or other materials in close proximity to the diaphragm. This reduces a rise in resonance, but at the expense of efficiency because resistive forms of damping waste otherwise useable energy at low frequencies. These forms of resistive loading also have little or no effect on the low frequency modal behavior of a diaphragm. Equalization is then required to make up for the effects of lost output. This increases the power requirement of an amplifier used to achieve enough output and decreases the power handling or thermal capacity of the loudspeaker.

SUMMARY OF THE INVENTION

The present invention is directed to acoustic loudspeakers which include transducers having a planar diaphragm mounted in a plane which is closely adjacent to at least one, and preferably two, stator plates on which are mounted magnetic elements. In preferred embodiments of the invention, the magnetic elements are permanent magnets of a bar type. An electrical circuit is carried by the planar flexible diaphragm so as to be responsive to the magnetic elements when electrical energy is passed through the electrical circuit thereby causing the diaphragm to vibrate at varying frequencies depending upon the power input.

It is one of the primary objects of the present invention to control a modal behavior of the flexible diaphragm such that it moves in a piston-like motion over a wide frequency range of predetermined interest and particularly for a flat panel type woofer operating in a frequency of 20 Hz to 200 Hz. To control the modal behavior, the present invention provides perforate openings in either one stator plate, if a single stator plate is used, or one or both stator plates, if two stator plates are used, wherein the openings are not uniformly distributed or sized so as to selectively create air pressure regions adjacent to the diaphragm that resist diaphragm motions on portions of the diaphragm where parts of the diaphragm would otherwise move out-of-phase with other parts of the diaphragm at certain operating frequencies. In preferred embodiments, the total open space created by the openings in the one or more stator plates is generally 20% or less of the total active or open surface area of the diaphragm. The active surface area is that which is defined between any mounting frame which supports the diaphragm at its outer edges and which is subject to vibration during the operation of the transducer.

In the preferred embodiments, the non-uniform spacing of the perforated openings in the transducer plate are such that the openings are not uniformly distributed across the surface of the plate but may be of greater density in one area of the plate than another. In other embodiments, the openings may vary in size and configuration along the stator plate so as to achieve the same resistive pressure of air adjacent to the diaphragm in areas of the diaphragm were modal control is desired.

In some embodiments, the selective air resistance adjacent the diaphragm may be created by providing openings of a first pattern in a front stator plate associated with a transducer and a different pattern in a rear stator plate associated with the same transducer. Further, in some embodiments, the openings through the stator plate may be flared or tapered such that they widen from a center of a stator plate to an outer surface or inner surface of the stator plate in order to further reduce undesired noise created by sound passing through the stator plate.

It is another object of the invention to use air stiffness to control diaphragms associated with planar magnetic and other flat diaphragm transducers at low frequencies in order to improve low frequency output of loudspeakers, and especially woofers, incorporating such transducers.

It is also an object of the present invention to provide for an improved method of increasing output, smoothing low frequency response and controlling low frequency resonance modes by making a stretched diaphragm behave like a piston through a wider range of frequencies in planar magnetic and other flat diaphragm type transducers used in loudspeakers and especially in woofers.

It is also an object of the invention to improve transfer efficiency of a planar magnetic or other flat type diaphragm transducer over a greater frequency range than is possible with current state of the art technologies.

It is another object of the invention to provide planar magnetic and other flat diaphragm transducers with one or more stator plates which are perforated non-uniformly so as to prevent interference of the stator plates with a vibrating diaphragm during operation of the transducers when the diaphragms are mounted closely adjacent to such stator plates.

Where the invention is used as a dipole, radiating sound from both sides, it is also an object of the invention to improve acoustic output by creating a pressure to velocity to sound pressure conversion beyond the boundary of the transducer such that the acoustic surface area is larger than the physical surface area of the transducer, lowering the dipole cutoff frequency.

BRIEF DESCRIPTION OF THE DRAWINGS

A better understanding of the invention will be had with respect to the accompanying drawings wherein.

DESCRIPTION OF PREFERRED EMBODIMENTS

Figure 1:
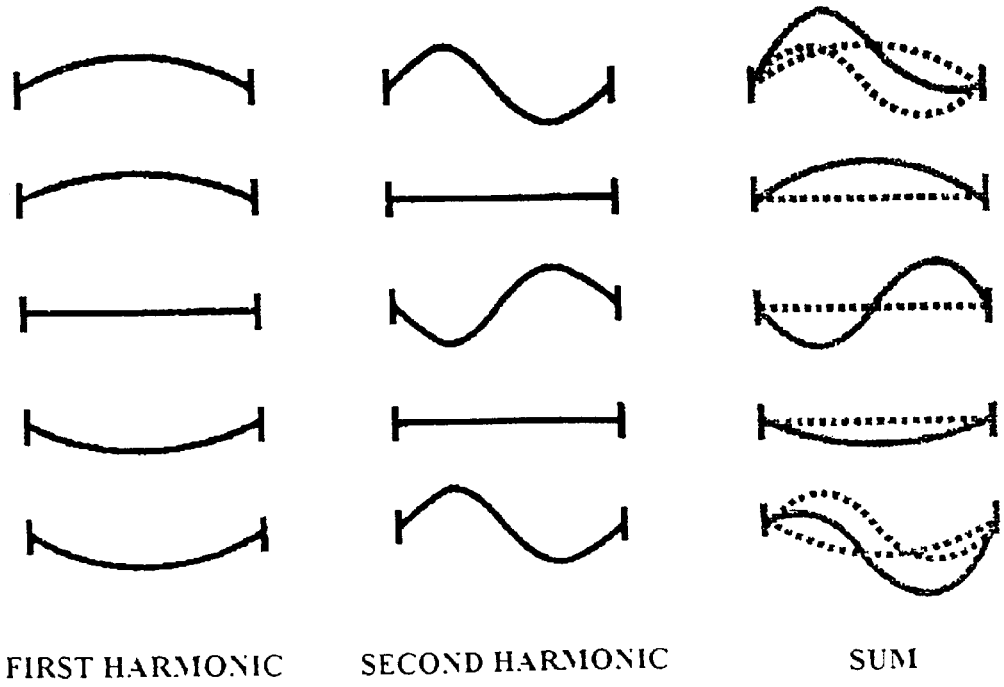
FIG. 1 is a graphic illustrating how a diaphragm in a flat type diaphragm transducer which is clamped at two ends will respond to vibration inputs as discussed in the description of the related art.

With continued reference to the drawings, the present invention is directed to loudspeakers and especially woofers incorporating flat diaphragm type transducers. The invention will be disclosed with respect to planar magnetic type transducers, however, it is not limited specifically thereto and would apply to other types of flat diaphragm transducers and loudspeakers incorporating such transducers.

With specific reference to FIGS. 4–9, a first embodiment of the invention is disclosed. The transducer 20 includes a stator housing having an upper stator plate 21 and lower stator plate 22 which are preferably formed of a mild magnetic steel material and which are joined around their peripheral portions by suitable fasteners such as screws or rivets 23. As shown, a flexible resonance diaphragm 24 is mounted with the stator housing. The diaphragm may be formed of a polyester film such as Mylar™ or Kapton™ or may be formed of various vinyl chlorides such as Saran™. Typically, such films are approximately 1 mil or less in thickness. Diaphragm 24 is clampingly mounted between the stator plates 21 and 22 in such a manner that a predetermined tension is maintained generally uniformly across the surface of the diaphragm.

The diaphragm is supported between the stator plates by insulating spacers 25 and 26 which are of a size to create an effective air gap dimension between the diaphragm and magnetic elements, such as permanent magnets 28, mounted within the housing and to the stator plates.

The portion of the diaphragm spaced inwardly of the stator plates 21 and 22 and spacer elements 25 and 26 is referred to as the "active", "open" or "sound producing area" of the diaphragm. This is the area of the diaphragm which vibrates when the transducer is in use.

The transducer shown in FIGS. 4–9 is described as a double-ended or push-pull transducer wherein the magnets 28 are provided on opposite sides of the diaphragm 24. The invention is also applicable to single ended transducers as well and may be directed to transducers having a single stator plate as opposed to the opposing plates shown in the drawing figures.

An electrical conductor or circuit pattern 32 is provided on the surface of the diaphragm 24 and is electrically connected at 33 and 34, when the stator plates are assembled, to positive and negative terminals 35 and 36 of the transducer. The terminals are connected to an appropriate source of electrical current such as an amplifier (not shown). The conductor pattern may be formed of substantially any material such as aluminum which may be formed with or secured to the diaphragm in any manner known in the art. Utilizing the configuration for the conductor pattern and the diaphragm shown in the drawing figures, the diaphragm will be generally uniformly driven for any position within the active area of the diaphragm between the stator plates.

In some embodiments, like pole faces of the magnets are oriented in opposing relationship on opposite sides of the diaphragm. The opposing pole faces create forces of repulsion between the magnets secured to the stator plates. It should be noted, however, that as opposed to having each of the magnets 28 having like pole faces, in some embodiments, the magnets on the same side of the diaphragm may have different poles facing or adjacent to the diaphragm. That is, one magnet may have its north pole facing the diaphragm with an adjacent magnet or magnets on both sides thereof having their opposite pole facing the diaphragm. Regardless of the pole orientation of the magnets along one side of the diaphragm, the opposing poles of the magnets on the opposite side of the diaphragm should be the same such that north poles align with north poles and south poles align with south poles. Again, transducers having a single stator plate are also contemplated.

The magnets shown in the drawing figures are preferably permanent magnets formed as elongated strips of rectangular cross-section. Preferred compositions of the magnetic material may vary and may include such materials as ceramic 5 or 8 or neodimium magnetic material. However, any other type of permanent magnet material or electromagnetic elements may be used in accordance with the teachings of the invention.

It is preferred that the magnets are secured to the stator plates in parallel rows, as shown, to the inner surface of the stator plates using a damping adhesive such as a silicone caulk. The magnets are spaced to allow passage of acoustical wave energy generated by the diaphragm through a plurality of non-uniformly spaced perforated openings 40 which are provided in at least one of the stator plates and, preferably, in each of the stator plates as shown in drawings 4–9.

One of the primary objects of the present invention is to control the modal behavior of the diaphragm 24 such that it is driven in a piston-like motion over a wide frequency range of interest. In a flat panel woofer type loudspeaker or transducer the frequency will be in the range of 20 Hz to 200 Hz. The diaphragm modal behavior is controlled by the open areas defined by the openings 40. In the preferred embodiments, the total open area defined by the openings is approximately 20% or less of the total "active" surface area of the diaphragm. Further, the distribution of the openings 40 relative to the diaphragm is predetermined so as to create air pressure regions with the stator housing that resist diaphragm motion on portions of the diaphragm 24 where parts of the diaphragm would move out-of-phase with other parts of the diaphragm at certain frequencies. The openings 40 increase the velocity of air at the openings where the speaker or transducer couples to the surrounding air. The openings also serve to create a bandpass operating region depending upon the size, position and path length of the openings. These characteristics of the openings are used to optimize the frequency range of a small flat panel loudspeaker and especially a woofer type transducer.

Figure 4:
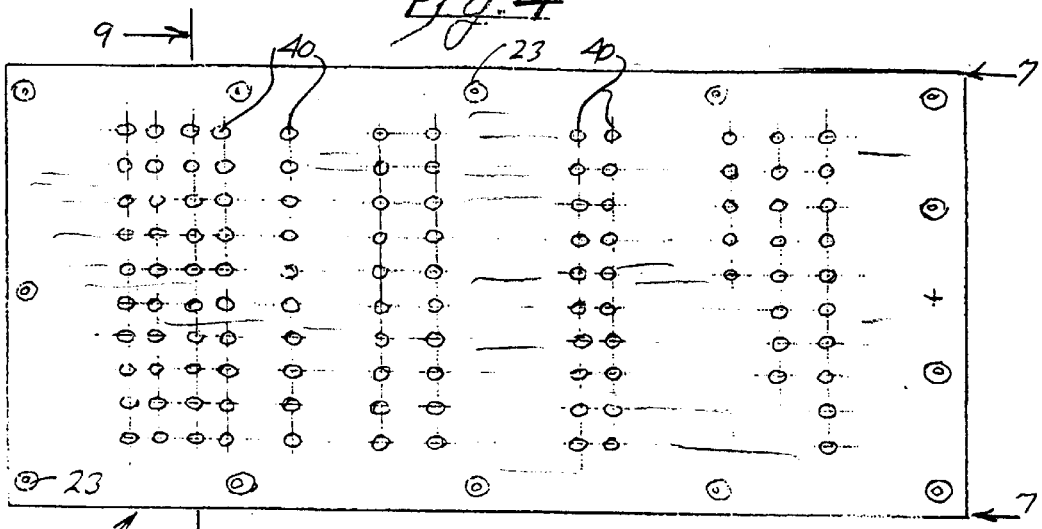
FIG. 4 is top plan view of a planar magnetic transducer constructed in accordance with the teachings of one embodiment of the present invention shown as assembled.
Figure 5:
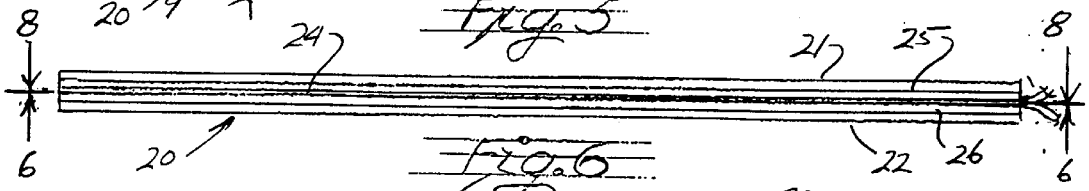
FIG. 5 is a side elevational view taken along line 5—5 of the transducer shown in FIG. 4.
Figure 6:
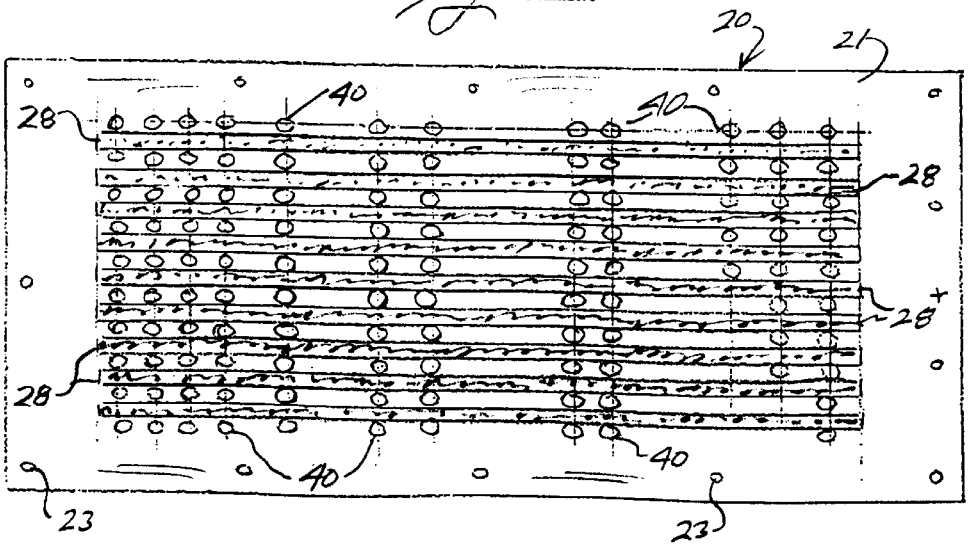
FIG. 6 is a cross-sectional view taken along line 6—6 of FIG. 5 showing the placement of elongated permanent magnets within the front stator plate of the transducer of FIG. 4.
Figure 7:
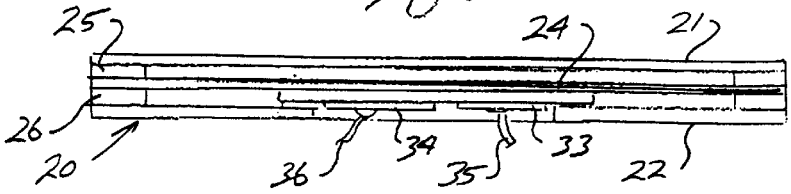
FIG. 7 is an end view taken along line 7—7 of FIG. 4.
Figure 8:
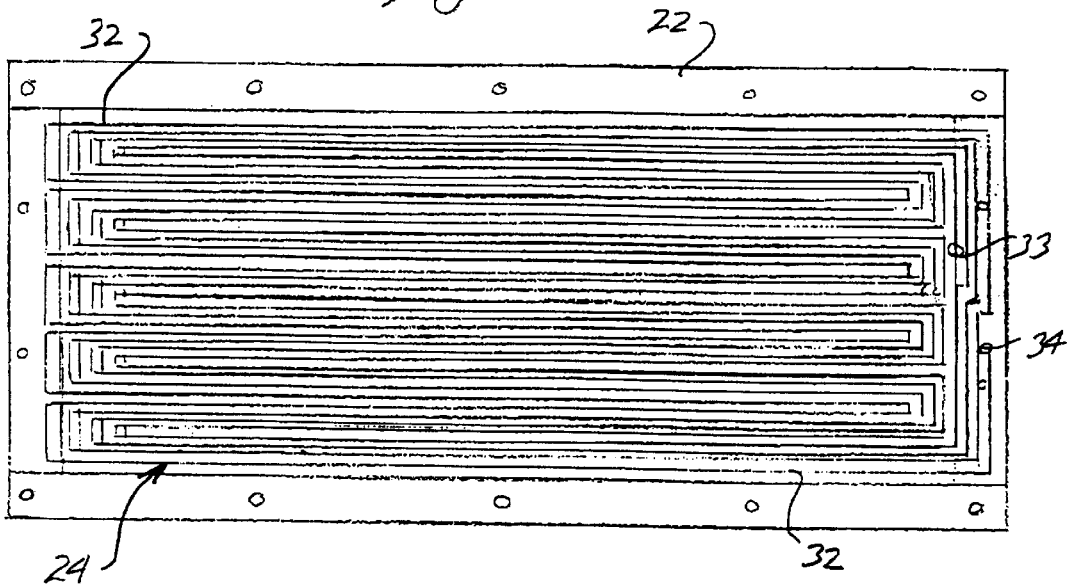
FIG. 8 is a cross-sectional view taken along line 8—8 of FIG. 5 showing an internal diaphragm having a conductor circuit applied thereto.
Figure 9:
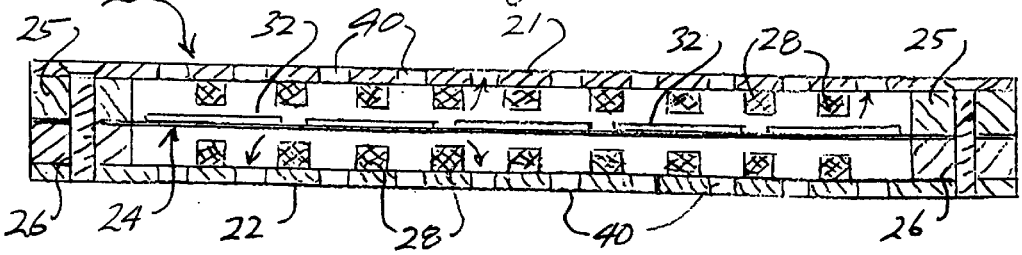
FIG. 9 is an enlarged cross-sectional view taken along line 9—9 of FIG. 4.

As specifically shown in FIGS. 4 and 5, the openings 40 are not uniformly spaced relative to the diaphragm. In this manner, resistive air spaces are provided between the stator plates and the diaphragm in order to provide for modal control of the diaphragm.

To optimize a given diaphragm, a mode shape analysis is performed on the transducer to determine patterns that interfere with smooth low frequency response of the diaphragm and thus the transducer or speaker. Once these patterns are determined, an opening distribution is designed that will damp out the destructive resonance mode or modes. The damping effect of the openings depends upon the open or active area and size of the diaphragm but is typically below 200 Hz. This is because the mechanical resistance of the diaphragm is very low and the acoustic output or vibration velocity of parts of the diaphragm is enhanced. The acoustic radiation output is high which creates high velocity air particles being forced through the openings 40. The force required to work against the radiation resistance is proportional to the cube of velocity, thus causing a high mechanical resistance to diaphragm motion where openings are not provided or are smaller.

Figure 2:
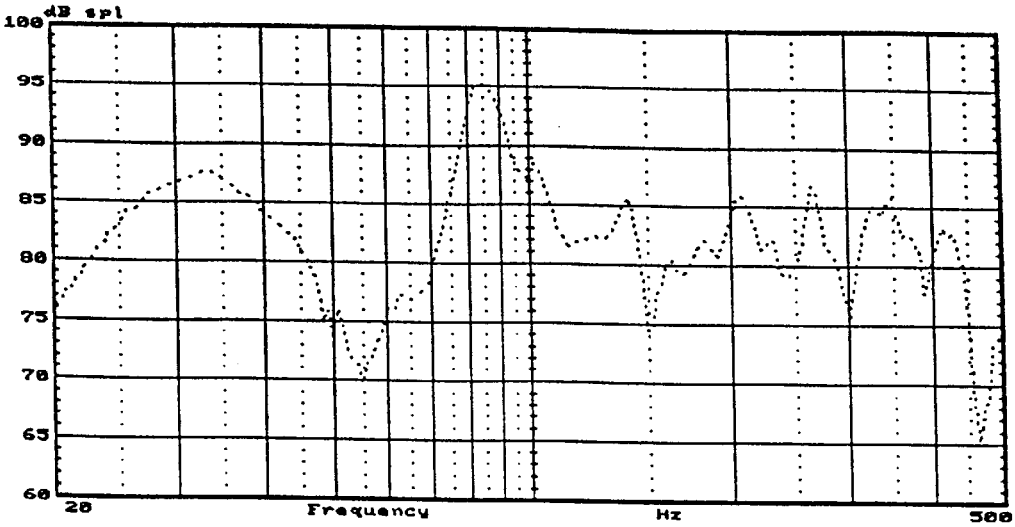
FIG. 2 is a frequency response curve showing a typical low frequency response of a planar diaphragm which is uniformly damped.

With specific reference to FIG. 2, a frequency response curve shows a typical low frequency response of a uniformly damp diaphragm in accordance with the prior art. The rise at resonance causes high acoustic output at this frequency. A dip in response above the resonance is due to out-of-phase operation of the diaphragm. At this frequency, it is also possible to cause a "bottoming" of the diaphragm against a stator plate because the acoustic output of the speaker is low for large displacements of portions of the diaphragm. When used in a loudspeaker, the apparent acoustic output would be low for high power input. The speaker would distort by "bottoming" the diaphragm against the stator plate.

Figure 3:
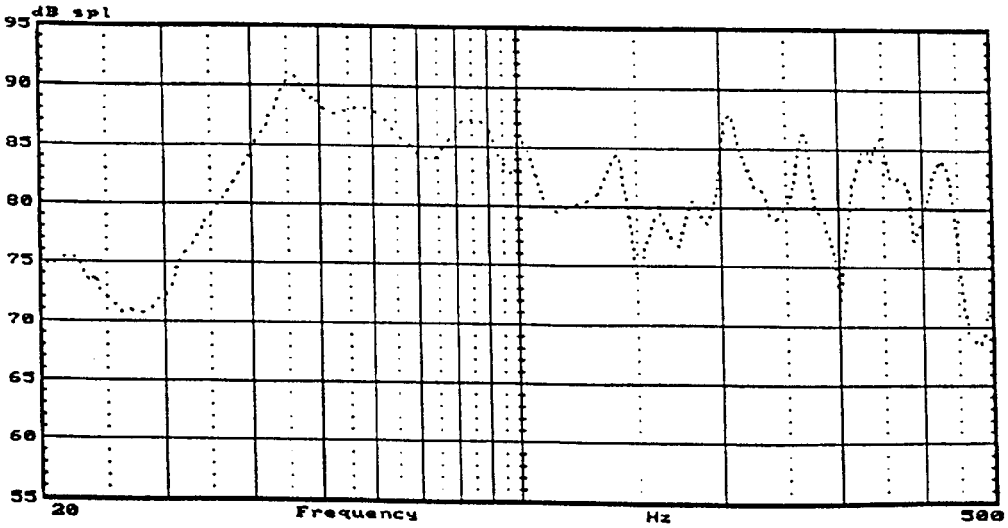
FIG. 3 is a frequency response curve showing the performance of a loudspeaker in accordance with the invention wherein the diaphragm is exposed to a non-uniform air load.

With specific reference to FIG. 3, a response curve of a speaker utilizing a transducer in accordance with the invention wherein a non-uniform air load is achieved is shown. As shown, a more uniform motion of the diaphragm results in a flatter response and a much higher acoustic output is obtained from the diaphragm 24 before the diaphragm is interfered with by "bottoming" against the stator plates.

Tests were made in measuring the acoustic output of an undamped diaphragm for peak-to-peak displacement of the diaphragm measured at its center verus the acoustic output of a speaker with the resistive loading applied by the methods of the present invention with the same measured displacement. Significant increases in acoustic output are measured for a given peak-to-peak displacement of the diaphragm using the teachings of the invention. The following Table A shows that the transducers of the present invention increase the acoustic output of a loudspeaker by creating piston-like diaphragm motions over a wider frequency range. This allows much smaller flat dipole diaphragms to produce meaningful low frequency acoustic output.

TABLE 1

| Frequency | Diaphragm Displacement (inch) | Undamped Diaphragm (db SPL) | Present Invention |
|---|---|---|---|
| 40 Hz | .010 | 62 | 71 |
| 40 Hz | .025 | 74 | 79 |
| 40 Hz | .040 | 81 | 85 |
| 50 Hz | .010 | 61 | 78 |
| 50 Hz | .025 | 77 | 84 |
| 50 Hz | .040 | 83 | 89 |
| 100 Hz | .010 | 62 | 86 |

In some embodiments of the invention, the non-uniform placement or provision of openings 40 within the stator plates 21 and 22 is such that the openings may be different in the front stator plate 21 than in the rear stator plate 22. The openings may be of different sizes or may be of different spacings or patterns in order to control modal behavior of a diaphragm as previously discussed. Again, it is desired to provide for selected areas of increased air resistance against portions of the diaphragm to provide proper modal behavior or control.

Figure 10:
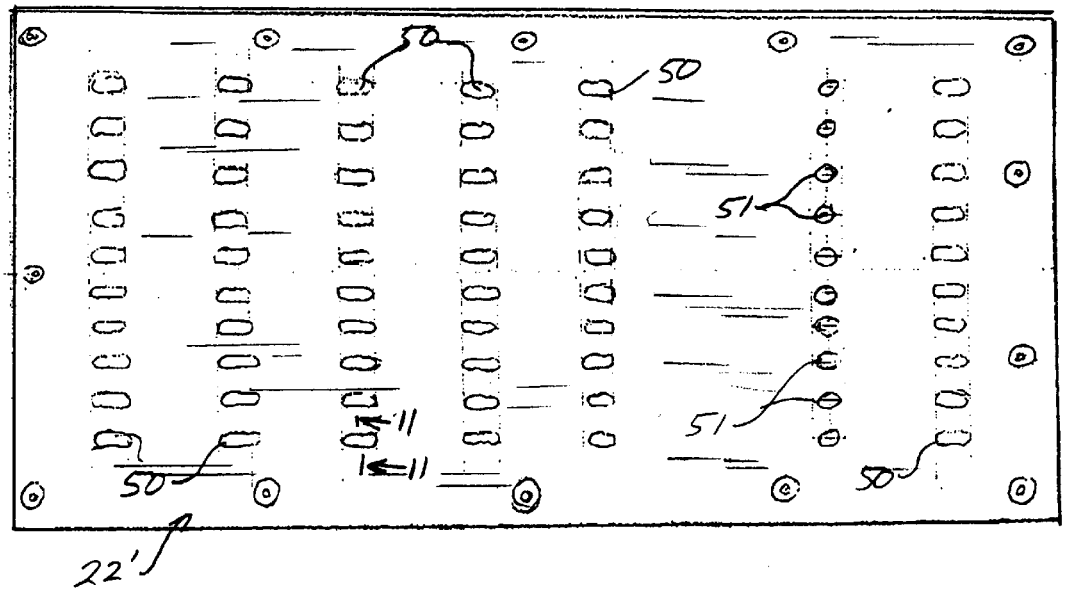
FIG. 10 is a top plan view of another embodiment of transducer stator plate showing a varied non-uniform opening pattern.

With specific reference to FIG. 10, a modified rear stator plate 22' is shown having openings 50 and 51 provided therein which are of a different pattern than those shown for the front stator plate 21 as shown in FIGS. 4 and 5. The openings 50 are generally uniform in size but are larger in dimension than the openings 51. Therefore, the size of the openings in the stator plates may also be utilized to create the air resistance within the space between the stator plates and the diaphragm in order to control the operating characteristics of the diaphragm 24.

Figure 11:
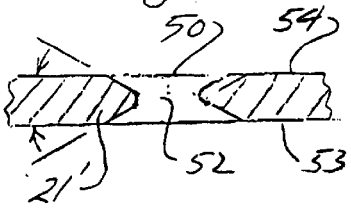
FIG. 11 is an enlarged cross-sectional view of an opening in the stator plate of FIG. 10 taken along line 11—11.

In addition to varying the dimension or size of the openings such as shown at 40, 50 and 51, the openings may also be designed to reduce noise by flaring the openings outwardly from a center of a stator plate to the inner and outer surfaces thereof. In FIG. 11 a cross-sectional view of one of the openings 50 of FIG. 10 is shown in cross-sectional detail. The opening 50 tapers outwardly from the center 52 thereof toward the outer surface 53 and the inner surface 54 of the stator plate. Such a flaring configuration in the opening reduces noise of air passing at high velocity through the opening.

Figure 12:
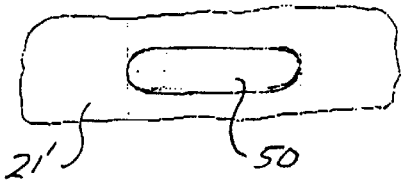
FIG. 12 is an enlarged top plan view of one configuration of opening which may be used to create non-uniform openings in accordance with the invention.
Figure 13:
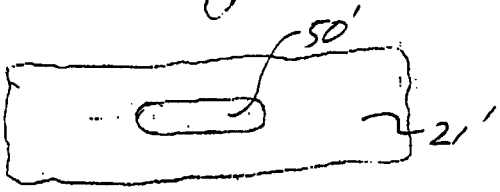
FIG. 13 is a view similar to FIG. 12 showing an opening of a varied size.

The openings in the stator plates need not be circular and may be of other configurations. FIGS. 12 and 13 show two different sizes of oblong openings 50 and 50' which may also be used to vary the air resistance between the stator plates and the diaphragm to control modal control of the diaphragm.

Figure 14:
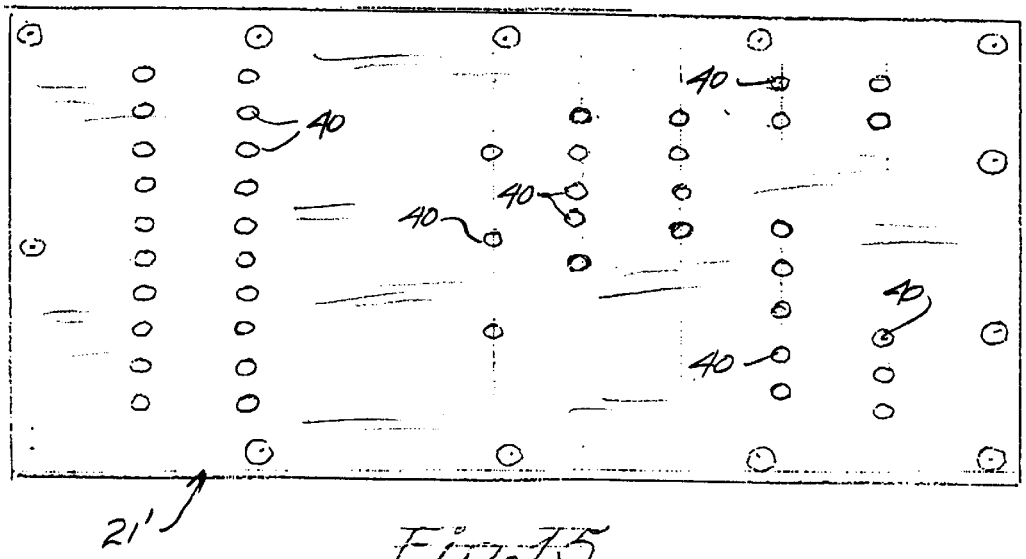
FIG. 14 is an illustrational top plan view of another non-uniform opening pattern for a stator plate.
Figure 15:
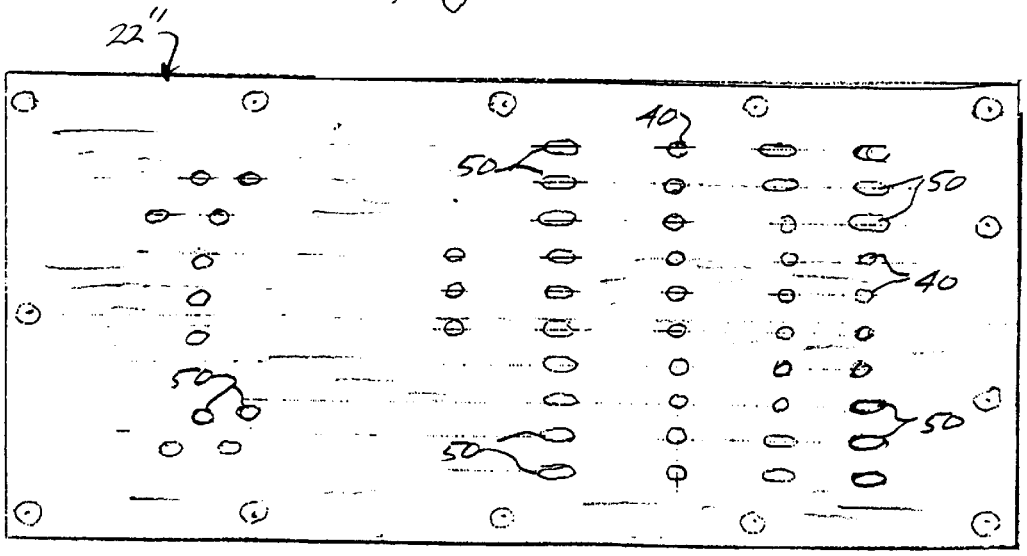
FIG. 15 is a further illustrational top plan view of a non-uniform opening pattern for a stator plate.

FIGS. 14 and 15 are exemplary top plan views of front stator plates 21' and 21' showing other variations in the placement and pattern of the openings 40 and 50 which are provided after a mode shape analysis is performed as previously described with respect to the frequency response of a given speaker. Once a determination is made with respect to the mode shape analysis, a predetermined opening distribution is designed to damp out the destructive resonance modes.

The low frequency limitations of a tensioned or stretched membrane type loudspeaker such as shown at 24 is further limited by the tension of the diaphragm. When the tension is reduced below a certain level, usually approximately 2 lbs. per square inch, loss of piston-like motion occurs and non-harmonic forms of distortion occur across the diaphragm. This prevents small diaphragms from achieving low frequency capability because the necessarily high tension results in a high fundamental resonance.

By way of example, a tension on the order of 2 lbs. per square inch on a rectangular diaphragm of approximately 5×7 inches in size yields a resonance frequency of about 120 Hz and that of a diaphragm of approximately 7×20 inches would yield a resonance frequency of about 60 Hz. The lower tension limit restricts the ability of the transducer to have significant output below these frequencies because of the high stiffness of the diaphragm. When low stiffness films are employed along with the modal control techniques as outlined above, the resonance frequency in the above examples can be reduced by at least a factor of 2 or more. The pressure regions around the diaphragms suspend and control it, lowering the distortion and allowing much lower frequency output from small flat panel loudspeakers such as small woofers.

The use of the techniques of the present invention allows lower stiffness films to be used and much lower resonance frequencies to be applied. With high compliance films, resonance frequencies of 30 Hz can be achieved on small panel speakers and 20 Hz or lower on larger type flat panel transducers.

The foregoing description of the preferred embodiments of the invention has been presented to illustrate the principles of the invention and not to limit the invention to the particular embodiments illustrated. It is intended that the scope of the invention be defined by all of the embodiments encompassed within the following claims and their equivalents.

I claim:

1. An acoustic loudspeaker including a transducer having a planar diaphragm mounted in a plane adjacent to at least one stator plate, an electrical circuit carried by said planar diaphragm, magnetic means mounted to said at least one stator plate, said at least one stator plate being generally imperforate with the exception of a plurality of non-uniformly spaced openings therethrough which are oriented in predetermined positions oriented in direct opposition with an active area of said planar diaphragm for purposes of selectively coupling air adjacent said planar diaphragm to air surrounding said transducer so as to thereby provide a resistive air load on at least one portion of said planar diaphragm to control modal resonance patterns on said planar diaphragm when electrical energy is applied to said electrical circuit.

2. The acoustic loudspeaker of claim 1 in which a total open area defined by said plurality of non-uniformly spaced openings is less than approximately 20% of said active area of said planar diaphragm.

3. The acoustic loudspeaker of claim 2 wherein at least one of said plurality of non-uniformly spaced openings is flared outwardly both toward an inner surface of said at least one stator plate and an external surface of said at least one stator plate.

4. The acoustic loudspeaker of claim 1 wherein said transducer includes a front stator plate and a rear stator plate with said planar diaphragm mounted therebetween, and each of said front and rear stator plates having a plurality of non-uniformly spaced openings therethrough.

5. The acoustic loudspeaker of claim 4 wherein a pattern of said plurality of non-uniformly spaced openings in said front stator plate is different than a pattern of said plurality of non-uniformly spaced openings in said rear stator plate.

6. The acoustic loudspeaker of claim 5 wherein a total open space defined by said plurality of non-uniformly spaced openings through said front and rear stator plates is approximately less than 20% of said active area of said planar diaphragm.

7. The acoustic loudspeaker of claim 6 wherein at least one of said plurality of non-uniformly spaced openings is flared outwardly both toward an inner surface of said front and rear stator plates and an external surface of said front and rear stator plates.

8. The acoustic transducer of claim 4 wherein a total open space defined by said plurality of non-uniformly spaced openings through said front and rear stator plates is approximately less than 20% of said active area of said planar diaphragm.

9. The acoustic loudspeaker of claim 8 wherein at least one of said plurality of non-uniformly spaced openings is flared outwardly both toward an inner surface of said front and rear stator plates and toward an external surface of said front and rear stator plates.

10. The acoustic loudspeaker of claim 8 wherein said transducer is a woofer operable in a range of proximately 20 Hz to 200 Hz.

11. The acoustic loudspeaker of claim 4 wherein said transducer is a woofer operable in a range of proximately 20 Hz to 200 Hz.

12. The acoustic loudspeaker of claim 1 in which a number of said plurality of non-uniformly spaced openings are of a different size than others of said openings.

13. The acoustic loudspeaker of claim 1 wherein said transducer is a woofer operable in a range of approximately 20 Hz to 200 Hz.

14. A stator plate for use with an acoustic loudspeaker including a planar diaphragm adapted to be mounted in a plane adjacent to the stator plate and on which an electrical circuit is provided for cooperating with magnetic means carried by the stator plate, said stator plate being generally imperforate between front and rear surfaces thereof with the exception of a plurality of non-uniformly spaced openings therethrough, said openings being provided so as to selectively couple air adjacent the planar diaphragm to air surrounding the stator plate and the diaphragm to thereby provide a resistive air load on at least a portion of the planar diaphragm to control modal resonance patterns on the diaphragm when electrical energy is applied to the electrical circuit of the diaphragm.

* * * * *